US006889634B1

(12) United States Patent
Roth

(10) Patent No.: US 6,889,634 B1
(45) Date of Patent: May 10, 2005

(54) METHOD OF PROVIDING HYDRAULIC PRESSURE FOR MECHANICAL WORK FROM AN ENGINE LUBRICATING SYSTEM

(75) Inventor: David B. Roth, West Bloomfield, MI (US)

(73) Assignee: BorgWarner Inc., Auburn Hills, MI (US)

( * ) Notice: Subject to any disclaimer, the term of this patent is extended or adjusted under 35 U.S.C. 154(b) by 0 days.

(21) Appl. No.: 10/826,104

(22) Filed: Apr. 16, 2004

(51) Int. Cl.[7] ..... F01M 1/02

(52) U.S. Cl. ..... 123/41.44; 123/41.65; 123/565; 123/90.12; 123/196 R; 180/442; 62/323.1; 290/1 R

(58) Field of Search ..... 123/196 R, 41.44, 123/41.65, 565, 90.12, 90.13; 180/442; 62/323.1; 290/1 R–1 D

(56) References Cited

U.S. PATENT DOCUMENTS 3,952,509 A 4/1976 Coleman ..... 60/422
4,000,756 A * 1/1977 Ule et al. ..... 123/90.12
4,420,937 A 12/1983 Naruse et al. ..... 60/450
4,596,517 A 6/1986 Laguionie ..... 417/216
4,819,430 A 4/1989 Becker ..... 60/421
5,291,864 A * 3/1994 Suga et al. ..... 123/198 R
6,644,025 B1 11/2003 Oberhausser et al. ..... 60/422
6,790,013 B2 * 9/2004 Hunter et al. ..... 417/220

* cited by examiner

*Primary Examiner*—Andrew M. Dolinar
(74) *Attorney, Agent, or Firm*—Brown & Michaels, PC; Greg Dziegielewski

(57) ABSTRACT

A method of providing hydraulic pressure for mechanical work from an engine lubricating system in an internal combustion engine by supplying oil to an engine lubrication gallery for lubricating the engine and at least one variable oil demand accessory. Each of the variable oil demand accessories have individual pressure regulators. The output of the variable displacement pump is regulated to the sum of fluid flow required by the engine lubricating system and the demand for fluid generated by the individual pressure regulators on each of the engine accessories, regardless of the engine output.

23 Claims, 2 Drawing Sheets

METHOD OF PROVIDING HYDRAULIC PRESSURE FOR MECHANICAL WORK FROM AN ENGINE LUBRICATING SYSTEM

BACKGROUND OF THE INVENTION

1. Field of the Invention

The invention pertains to the field of engine lubricating systems. More particularly, the invention pertains to a method of providing hydraulic pressure for mechanical work from an engine lubricating system.

2. Description of Related Art

Conventionally, accessories in cars, (i.e. cooling fan, power steering system, A/C compressor, engine coolant pump, supercharger, and alternator) are powered using separate engine driven, fixed displacement pumps, or by direct drive, where the individual power demands of the accessories are not well matched to engine speed.

Solutions to the allocation of power by accessories is shown in U.S. Pat. No. 3,952,509, U.S. Pat. No. 4,420,937, U.S. Pat. No. 4,819,430, U.S. Pat. No. 5,800,131 and U.S. Pat. No. 6,644,025.

In U.S. Pat. No. 3,952,509 a variable displacement pump supplies hydraulic fluid to continuous and intermittent output hydraulic circuits. The continuous circuit supplies pressure for the power steering in a tractor, and the intermittent circuit provides pressure for activating hydraulic rams, for example, moving an auger up and down. A first flow divider provides constant pressure to the continuous hydraulic circuit. A second flow divider provides pressure if any of the hydraulic cylinders in intermittent hydraulic circuit are actuated. The loads on the system are for hydraulic pistons and not continuous flow devices (motors), and the system does not provide engine lubrication.

U.S. Pat. No. 4,420,937 discloses a system where the displacement of a variable displacement pump in a hydraulic circuit is at a minimum when the actuators in the system are not operating. The circuit includes a flow sensor that detects the dynamic pressure of a fluid and can covert static pressure to dynamic pressure.

U.S. Pat. No. 4,819,430 discloses a hydraulic fluid circuit that is divided into two circuits, first and second. A variable displacement pump is the fluid source for the first, primary circuit for steering. The second circuit is controlled by a fixed displacement pump. A valve responsive to the demands between the first circuit and the second circuit increases the amount of output from the fixed pump into the fir first circuit in proportion to the output of the variable displacement pump.

U.S. Pat. No. 5,800,131 discloses a variable displacement pump regulating engine lubricating oil flow based on engine parameters. U.S. Pat. No. 5,800,131 uses oil pressure to move a piston.

U.S. Pat. No. 6,644,025 discloses a control arrangement that supplies pressured hydraulic fluid to at least two hydraulic consumers. The control arrangement includes a variable displacement pump, which is controlled according to required flow and settings and pressure compensators. This control arrangement prevents excess flow of hydraulic fluid to the consumers by suing the pressure compensators and allows only one valve device to derive the control pressure from the feed pressure.

SUMMARY OF THE INVENTION

A method of providing hydraulic pressure for mechanical work from an engine lubricating system in an internal combustion engine by supplying oil to an engine lubrication gallery for lubricating the engine and at least one variable oil demand accessory. Each of the variable oil demand accessories have individual pressure regulators. The output of the variable displacement pump is regulated to the sum of fluid flow required by the engine lubricating system and the demand for fluid generated by the individual pressure regulators on each of the engine accessories, regardless of the engine output.

DETAILED DESCRIPTION OF THE INVENTION

Figure 1:
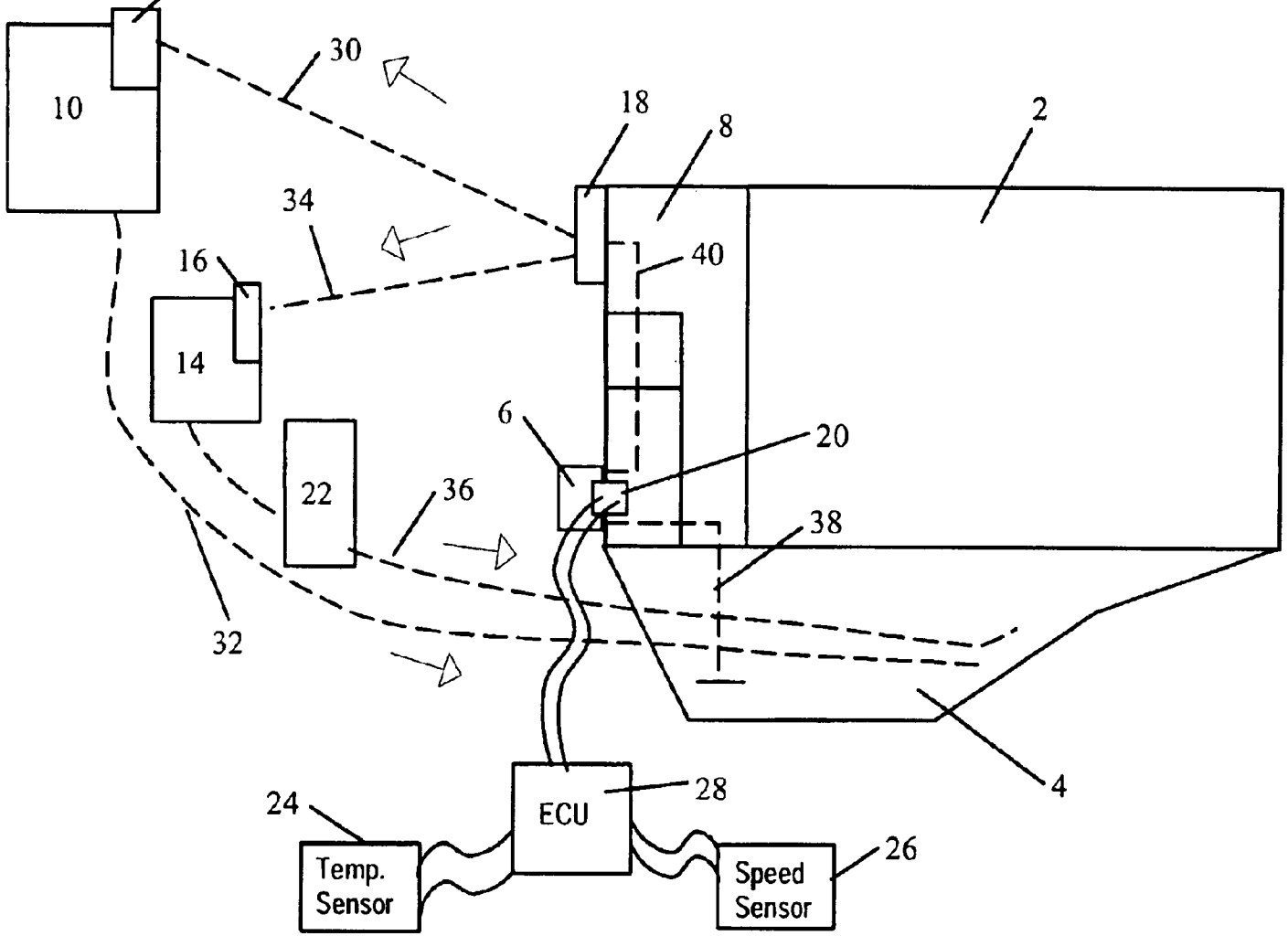
FIG. 1 shows a schematic of system of the current invention.
Figure 2:
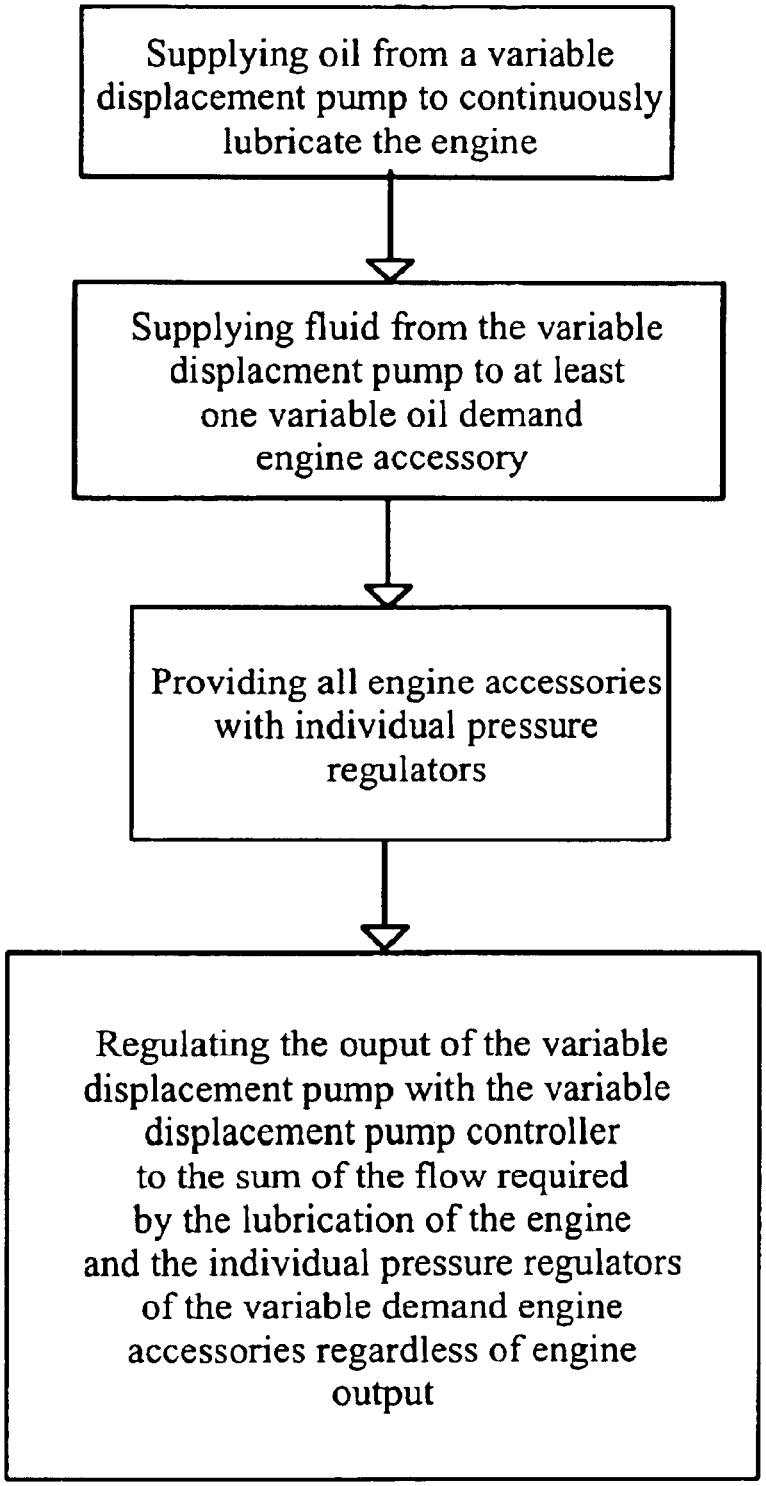
FIG. 2 shows a flow chart of the steps of the current invention.

Referring to FIGS. 1 and 2, mounted to the front cover 8 of the engine block 2 is a variable displacement pump 6 and the variable displacement pump controller 20. Below engine block 2 is a sump or oil pan 4. Also connected to the front cover 8 of the engine block 2 is the high pressure manifold 18.

The variable displacement pump 6 is driven by a conventional valve chain, gear, or belt (not shown). Line 38 connects the variable displacement pump 6 to the sump 4. Line 40 passes though the front cover 8 of the engine block 2 and connects the variable displacement pump 6 to the high pressure manifold 18. The high pressure manifold 18 may be incorporated into the front cover or be a completely separate and external. The variable displacement pump 6 is regulated by the variable displacement pump controller 20 to the sum of fluid or oil required by lubrication of the engine and the fluid demanded by the variable on-demand engine accessories 10, 14. The controller 20 receives input from ECU 28, which monitors the temperature sensor 24, engine speed sensor 26, and other sensors relating to engine performance, such as load and vehicle speed.

Each accessory, 10, 14 which for example may be, hydraulic motor-driven cooling fan, A/C compressor, engine coolant pump, alternator, supercharger, electrohydraulic valve actuation system, suspension actuators such as pumps or motors, and power steering system. The amount of fluid each of the accessories 10, 14 needs is monitored by separate electronic pressure regulators 12, 16 respectively. For the power steering system, the power steering fluid power would be controlled by the current state-of-the-art power steering control valve.

The return fluid from the engine accessories is supplied to the sump or oil gallery 4 via lines 32 and 36. Lines 32 and 36 both connect at cooler 22 and one line leads to sump 4. Alternatively, lines 32 and 36 may combine into one line prior to entering cooler 22. The pressure regulators 12, 16 of the engine accessories, 10, 14 are each connected to the high pressure manifold 18 via lines 30 and 34 respectively, and use the high pressure manifold 18 as their power source. It should be noted by one skilled in the art that even though two engine accessories are shown in FIG. 1, one or more engine accessories may be used with the system.

By combining the demands of the engine accessories 10, 14 with the engine lubrication system to a single variable displacement pump 6, and regulating the variable displacement pump 6 to the sum of the flow required by the engine lubricating system and the amount of fluid demanded by the engine accessories 10, 14, the efficiency of all of the systems associated with the circuits are increased, since instantaneous fluid power is provided when demanded.

FIG. 2 shows the steps for providing hydraulic pressure for mechanical work from an engine lubricating system by first, supplying oil or fluid from the variable displacement pump 6 to lubricate the engine. Next, the same variable displacement pump 6 provides fluid or oil to at least one of the variable oil demanding engine accessories 10, 14. Each of the engine accessories is also provided with individual pressure regulators 12, 16. Then, the variable displacement pump 6 is regulated by the variable pump controller 20, which takes into account the temperature and speed sensors monitored by the ECU 28, to the sum of flow required by the engine lubricating system, which is continuous, though variable, and the individual pressure regulators 12, 16 of the variable on-demand engine accessories 10, 14, regardless of the engine output.

Accordingly, it is to be understood that the embodiments of the invention herein described are merely illustrative of the application of the principles of the invention. Reference herein to details of the illustrated embodiments is not intended to limit the scope of the claims, which themselves recite those features regarded as essential to the invention.

What is claimed is:

1. A method of providing hydraulic pressure for mechanical work from an engine lubricating system in an internal combustion engine, the steps comprising:

a) supplying oil from a variable displacement pump to an engine lubrication gallery for lubricating the engine;

b) supplying oil from the variable displacement pump to at least one engine accessory having a variable oil demand, the accessories each having individual pressure regulators;

c) regulating the output of the variable displacement pump to a sum of fluid flow required by the engine lubrication system and demand of fluid generated by the individual pressure regulators of the engine accessories regardless of engine output.

2. The method of claim 1, wherein at least one engine accessory is a hydraulic motor driven cooling fan.

3. The method of claim 1, wherein at least one engine accessory is a power steering system.

4. The method of claim 1, wherein at least one engine accessory is a hydraulic motor driven air conditioning compressor.

5. The method of claim 1, wherein at least one engine accessory is a hydraulic motor driven engine coolant pump.

6. The method of claim 1, wherein at least one engine accessory is a hydraulic motor driven alternator.

7. The method of claim 1, wherein at least one engine accessory is a hydraulic motor driven supercharger.

8. The method of claim 1, wherein at least one engine accessory is an electrohydraulic valve actuation system.

9. The method of claim 1, wherein at least one engine accessory is a suspension actuator motor.

10. The method of claim 1, wherein the fluid flow for lubricating the engine is based on engine parameters.

11. A hydraulic on-demand engine accessory drive system for an internal combustion engine comprising:

a variable displacement pump mounted to a front cover of an engine block having a fluid communication input from a sump and an fluid communication output to a high pressure manifold;

a variable displacement pump controller mounted to the variable displacement pump and in communication with an ECU;

at least one engine accessory having variable oil demand and an individual pressure regulator, wherein the pressure regulator is in fluid communication with and has an input from the high pressure manifold and an output to the sump;

wherein the output of the variable displacement pump is regulated by the variable displacement pump controller to a sum of flow required by the individual pressure regulator of the at least one engine accessory and lubrication of the engine, regardless of engine output.

12. The system of claim 11, wherein the high pressure manifold powers the individual pressure regulator.

13. The system of claim 11, wherein the ECU monitors sensors on the engine.

14. The system of claim 13, wherein the sensors monitor temperature and speed of the engine.

15. The system of claim 11, wherein at least one engine accessory is a hydraulic motor driven cooling fan.

16. The system of claim 11, wherein at least one engine accessory is a power steering system.

17. The system of claim 11, wherein at least one engine accessory is a hydraulic motor driven air conditioning compressor.

18. The system of claim 11, wherein at least one engine accessory is a hydraulic motor driven engine coolant pump.

19. The system of claim 11, wherein at least one engine accessory is a hydraulic motor driven alternator.

20. The system of claim 11 wherein at least one engine accessory is a hydraulic motor driven supercharger.

21. The system of claim 11, wherein at least one engine accessory is an electrohydraulic valve actuation system.

22. The system of claim 11, wherein at least one engine accessory is a suspension actuator motor.

23. The system of claim 11, further comprising an oil cooler in the output of the at least one engine accessory to the sump.

* * * * *